United States Patent [19]

Metcalf

[11] 4,125,896

[45] Nov. 14, 1978

[54] DIGITAL NORMALIZING CIRCUIT

[75] Inventor: William T. Metcalf, North Amherst, Mass.

[73] Assignee: Hentschel Instruments, Inc., Ann Arbor, Mich.

[21] Appl. No.: 806,820

[22] Filed: Jun. 15, 1977

[51] Int. Cl.[2] ..... G06J 1/00

[52] U.S. Cl. ..... 364/606; 235/92 DM; 340/347 NT; 364/582

[58] Field of Search ..... 235/150.52, 150.51, 235/196, 92 DM; 328/161; 340/347 NT; 364/605, 606, 850, 582

[56] References Cited

U.S. PATENT DOCUMENTS

| | | | |
|---|---|---|---|
| 3,435,193 | 3/1969 | Aitchison | 235/150.52 |
| 3,749,894 | 7/1973 | Avdeef | 235/150.52 |
| 3,768,009 | 10/1973 | Dorey et al. | 340/347 NT X |
| 3,943,341 | 3/1976 | Corsi et al. | 235/150.52 |
| 4,024,533 | 5/1977 | Neumann | 340/347 NT |

*Primary Examiner*—Joseph F. Ruggiero
*Attorney, Agent, or Firm*—Olsen and Stephenson

[57] ABSTRACT

A computing circuit is disclosed for producing a digital representation of the ratio between a reference analog signal and successive analog signals that are successively supplied to a single input of the computing circuit. The computing circuit comprises storage means in which a digital representation of the reference analog signal is retained. For each successive analog signal that is supplied to the input of the computing circuit, a digital output is generated that is commensurate with the values of the supplied successive analog signal and the digital representation of the reference analog signal retained in the storage means. The digital output is displayed in numerical form representing the ratio between the reference analog signal and the successive analog signal.

7 Claims, 3 Drawing Figures

DIGITAL NORMALIZING CIRCUIT

BACKGROUND OF THE INVENTION

The present invention relates generally to computing circuits, and more particularly, to a computing circuit for producing a digital output representing the ratio between a selected pair of analog signals. Circuits capable of producing a digital output representing the ratio between a pair of analog signals are known. One such circuit is disclosed in U.S. Pat. No. 3,752,972, issued to Campbell, Jr., on Aug. 14, 1973, and requires the simultaneous supply of a reference analog signal and a test analog signal to the computing circuit in order to produce an output representing the ratio between the two signals.

The reference analog signal must remain constant for each test to provide ratio readings that are consistent. For example, if it is desired to determine whether a given characteristic of a workpiece is within a selected percentage of the given characteristic of a selected reference workpiece, the reference analog signal representing that characteristic must be continually generated and supplied to the computing circuit along with the analog signal of the tested workpiece. If during the testing of successive workpieces the tested characteristic should be altered on the selected reference workpiece due to external conditions such as heat, etc., an unreliable ratio will be produced which may result in the rejection of good workpieces and the acceptance of workpieces which do not conform to the desired standard. Thus, computing circuits requiring more than one test input have inherent disadvantages.

It is therefore the object of the present invention to provide a computing circuit having a memory function for retaining a value representing a selected analog signal.

SUMMARY OF THE INVENTION

In accordance with the present invention, a computing circuit is provided for generating a digital representation of the ratio between a selected pair of analog signals. In one form of the invention, the computing circuit includes a ramp-comparison analog to digital converter and a source of pulse signals to produce a series of pulse signals representative of an analog signal that is supplied to a single input of the computing circuit. The computing circuit also includes counters, pulse rate multipliers, switches and control circuitry arranged so that a digital representation of a selected analog signal is retained in one of the counters. A subsequent analog signal is applied to the computing circuit in a manner in which the number of pulses generated are comensurate to the values of the stored reference signal and the test analog signal being supplied to the computing circuit. The pulses are transmitted to a display indicating the ratio between the reference and test analog signals. The control circuitry thereafter provides for the resetting of all the devices except the counter in which the reference analog signal is stored. A subsequent test analog signal is then supplied to the computing circuit which generates another ratio in digital form of the reference and test analog signals.

In another form of the invention, the computing circuit includes a dual slope integration analog to digital converter providing for the converting of the analog signals to a digital form. The dual slope integrator controls the supply of pulse signals to dividing means which divides the incoming pulse rate representing the reference analog signal by a predetermined value. The output of the dividing means is displayed on a panel providing an absolute reading of the reference analog signal and is also supplied to a counter which serves as storage means and which is operatively associated with the dividing means. Subsequent analog signals are fed through the dividing means which produces a digital output in accordance with the value representative of the reference analog signal and retained in the counter and the value of the test analog signal being supplied to the computing circuit so that the output displayed is the ratio between the reference signal and the test analog signal. Control circuitry provides for the resetting of all devices, except the storage counter so the subsequent analog signal can be inputted to enable the computing circuit to develop another ratio.

The computing circuit of the present invention can further serve as a meter for testing the value of various signals and producing a digital readout. Or as previously indicated, the computing circuit can function as a test instrument providing a readout indicating the percentage deviation of the test workpiece relative to a desired standard.

Further objects, features and advantages of the present invention will become apparent from a consideration of the following description when taken in connection with the appended claims and the accompanying drawing in which:

Figure 1:
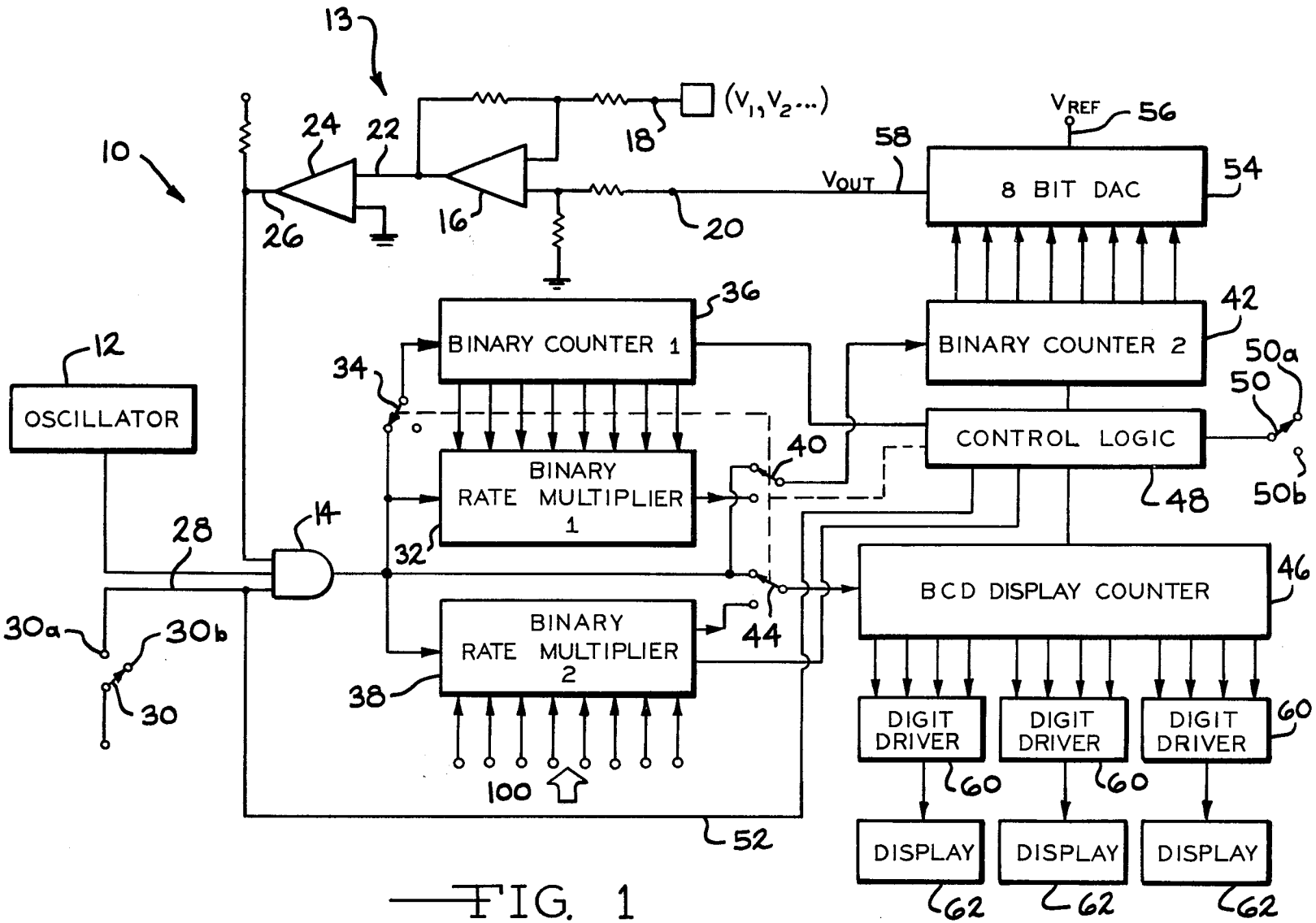
FIG. 1 is a schematic diagram of the computing circuit of the present invention.

Referring to the drawing, the computing circuit of the present invention, indicated generally at 10 in FIG. 1, functions to make a digital reference reading of a predetermined analog level and to divide all subsequent inputted analog levels by the reference reading to yield a normalized output in digital form that deviates about a selected number such as the number one. The computing circuit 10 includes means for producing pulse signals in the form of an oscillator 12 and control means 13 in the form of a ramp-comparision analog to digital converter having an input to which the analog signals are supplied for the purpose of controlling the output of the oscillator 12 to first produce a digital representation of the predetermined analog signal which will be used as a reference signal for subsequent computations. The reference signal is stored in storage means. The computing circuit 10 thereafter functions to control the oscillator 12 to produce a second group of pulse signals commensurate with the value of a successive analog signal being inputted to the computing circuit 10 and commensurate with the stored digital representation of the reference analog signal so that the second group of pulses represents the ratio between the reference analog signal and the successive analog signal being supplied to the computing circuit 10.

The control means 13 includes an AND gate 14, a summing amplifier 16 and a comparator 24. The summing amplifier 16 has an input 18 through which the reference and the subsequent test analog signals are supplied and a second input 20 through which a signal developed within the circuit 10 is supplied. The summing amplifier 16 has an output 22 which forms an input to the comparator 24 which has an output 26 that serves as an input to the AND gate 14. The summing amplifier 16 and the comparator 24 are arranged so that whenever the value of the signal (normally a voltage level) on the input 20 of the summing amplifier 16 is equal to or greater than the value of the signal at the input 18, the output of the comparator 26 will be low. Otherwise, the output of the comparator 26 will remain at a high logic level state.

The AND gate 14 further includes another input 28 which is connected through a switch 30 having contacts 30*a* and 30*b* to a suitable voltage source (not shown) so that when the contact 30*a* is closed, a logic high level signal will be supplied to the input 28 of the AND gate 14. When the output of the comparator 26 is high and the switch 30 is set closing the contact 30*a*, a high level signal is supplied to the input 28 and the AND gate 14 will pass the pulse signals developed by the oscillator 12. The output of the gate 14 is connected to a binary rate multiplier (BRM) 32, which, in the illustrated embodiment forms pulse control means, through a switch 34 to a first binary counter 36 which serves as storage means for a reference analog signal, and to a binary rate multiplier (BRM) 38. The binary rate multiplier 38 has its inputs hardwired to a selected numerical value such as 100 and functions as a scaling factor for the displayed output of the ratio between the reference and analog signals. It is to be understood that any suitable number could be inputted into the multiplier 38 to provide for the deviation about that number.

The AND gate 14 is also connected through a switch 40 to a second binary counter 42 and through a switch 44 to a binary coded decimal display counter 46. Suitable control logic circuitry 48 is provided which functions to control the opening and closing of the switches 34, 40 and 44. The control logic circuitry 48 is also suitably connected to the counters 36 and 42, the binary rate multipliers 32 and 38 and to the binary coded decimal display counter 46 so as to provide for resetting these devices in response to an operator actuated signal.

A switch 50 is provided having contacts 50*a* and 50*b*. When the contact 50*a* is closed, the control logic 48 sets the switches 34, 40 and 44 in the position shown in FIG. 1. That is, the output of the AND gate 14 is connected through the switch 34 to the counter 36, through the switch 40 to the counter 42, and through the switch 44 to the counter 46. When the switch 50 is set to close the contact 50*b*, the switches 34, 40 and 44 are moved to the opposite position. Switch 34 is opened preventing any additional counts from being added to the counter 36. Switch 40 is moved to connect the output of the multiplier 32 directly to the counter 42 and open the direct line between the AND gate 14 and the counter 42. Similarly, the switch 44 is moved to open the direct line between the AND gate 14 and the counter 46 so that the output of the multiplier 38 is connected to the counter 46. A line 52 connects the switch 30 to the control logic 48 for purposes of providing an external command signal to the control logic 48. When the contact 30*b* is closed, the low level signal applied to the control circuitry 48 provides for resetting both the counters 42 and 46 to zero and for initializing the BRMs 32 and 38.

The binary counter 42 has an associated digital to analog converter (DAC) 54 having a voltage reference input ($V_{ref}$) 56 which is set at a level greater than any analog signal supplied to the input 18. The DAC 54 has an output 58 which is connected to the input 20 of the summing amplifier 16.

The counter 46 is provided with digit drivers 60 and display panels 62 for purposes of displaying the decimal equivalent of the binary digital output produced by the AND gate 14 or the BRM 38.

The disclosed computing circuit 10 uses 8-bit conversion, although 10 or 12 bits or other suitable values could have been selected. Thus, for purposes of illustration only and not by way of limitation, the operation of the present invention will be made in reference to the use of an 8-bit conversion system.

With the contact 50*a* closed and a reference analog signal $V_1$ being supplied to the input 18, the absolute conversion of the reference analog signal to a digital signal proceeds as follows. The switches 34, 40 and 44 are in the positions shown in FIG. 1 with the counters 36, 42 and 44 all set at zero and the BRMs 32 and 38 initialized. Therefore the signal $V_{out}$ on output 58 of the converter 54 is also at zero so that the output 26 of the comparator 24 is at a high logic level state. The operator closes contact 30*a* of the switch 30 so that a logic high level signal is applied to the input 28 of the AND gate 14 thereby enabling the AND gate 14 to pass the pulses developed by the oscillator 12.

The output signal pulses of the oscillator 12 synchronously clock the binary counters 36 and 42 and the display counter 46. The binary counter 42 increments the digital to analog converter 54 thus increasing the signal level $V_{out}$ on output 58. When the number inputted in the binary counter 42 is at a level to cause the output $V_{out}$ of the converter 54 to become greater than the reference analog signal $V_1$ on input 18, the amplifier 16 which functions to amplify the difference between the signal levels at its inputs 18 and 20 changes to a low logic level state which in turn causes the comparator 24 to produce a low output thereby turning off the AND gate 14. The counters 36, 42 and 46 cease counting and have a number on their outputs which is a digital representation of the reference analog signal.

The switch 50 is moved to close the contact 50*b* which notifies the control logic circuitry 48 to activate the switches 34, 40 and 42. The switch 34 is opened; the switch 40 is moved to connect the binary counter 42 to the binary rate multiplier (BRM) 32, and; the switch 44 is moved to connect the binary rate multiplier (BRM) 38 to the counter 46. The switch 30 is moved to close the contact 30*b* providing a logic low level signal to be supplied to the control logic 48 which provides for the resetting of the counters 42 and 46 to zero and the initializing of the BRMs 32 and 38. The counter 36 is not reset and retains the digital representation of the reference analog signal.

A successive test analog signal ($V_2$) is supplied to the input 18 of the amplifier 16 and the contact 30*a* is closed providing for a high level input on the line 28 to enable the clock pulses to pass through the AND gate 14. In the normalized conversion, the output pulses of the AND gate 14 are supplied to the binary rate multiplier 32 whose output is fed through the switch 40 to the binary counter 42. Similarly, the output of the AND gate 14 is fed through the binary rate multiplier 38 to the display counter 46. The binary rate multiplier 32 functions to reduce the pulse rate of the output of the AND gate 14 in accordance with the digital representation on the outputs of the counter 36 which is the digital representation of reference analog signal $V_1$. The binary counter 42 is accordingly incremented until the output of the DAC 54 equals the input of the test analog signal $V_2$ on the input 18. When the output 58 equals the input on line 18, the comparator 24 shifts to a low output turning off the AND gate 14. During this time period, the output of the AND gate 14 is fed through the binary rate multiplier 38 which has a predetermined value such as 100 placed on its inputs and through the switch 44 to the display counter 46. Thus during the normalized conversion, the number of pulses transmitted through the AND gate 14 are dependent upon the value of the successive test analog signal $V_2$ being inputted to the amplifier 16 and also are dependent upon the value of the number retained in the counter 36 which is the digital representation of the reference analog signal $V_1$. The number of pulses transmitted by the AND gate 14 represent the ratio between the reference analog signal $V_1$ and the test analog signal $V_2$ being supplied to the input 18.

Figures 2, 3:
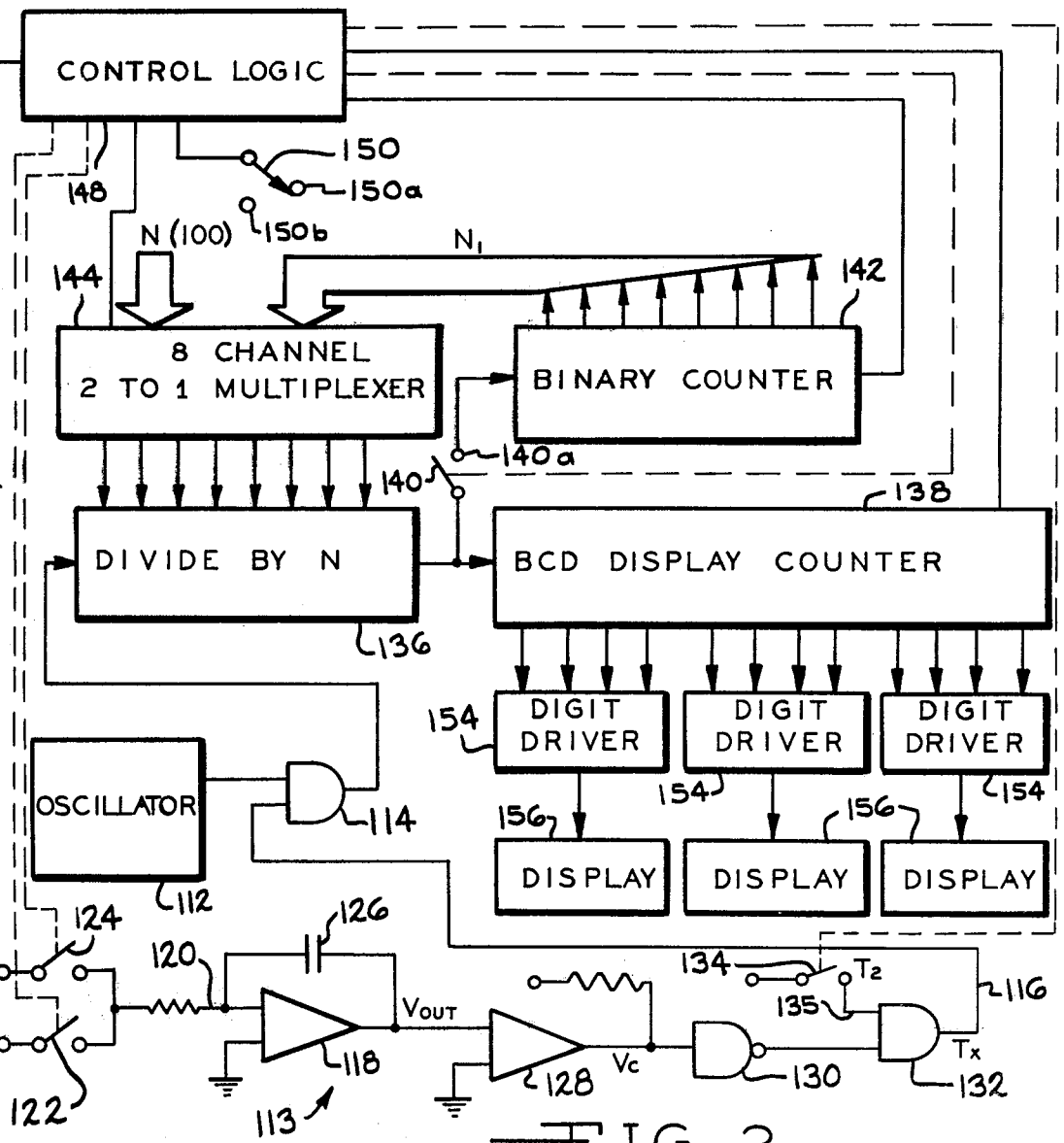
FIG. 2 is a schematic diagram of another computing circuit embodying the present invention.
FIG. 3 is a timing diagram representative of the output of a dual slope integration analog to digital converter shown in FIG. 2.

The present invention can be adapted for use with a dual slope integration analog to digital converter as viewed in FIG. 2. A computing circuit 110 is shown having an oscillator 112, and control means 113 in the form of a dual slope integration analog to digital converter which has an output 116 that forms one input to an AND gate 114. The other input of the AND gate 114 is connected to the oscillator 112 and the AND gate 114 serves to pass the pulse signals generated by the oscillator 112 whenever the output of the dual slope integration A/D converter is developing a high logic level state on output 116.

The converter 113 includes an integrator 118 having an input 120 which is selectively connected to a constant reference signal ($+V_{ref}$) through a switch 112 and to an analog signal ($-V_{in}$) of opposite polarity through a switch 124. Thus the reference analog signal $V_1$ and the test analog signals $V_2$ are successively entered into the converter 113 through a single input in the form of the switch 124. The amplitude of the output of the integrator 118 is controlled by the value of the analog signals applied to the input 120 and by a capacitor 126.

The output ($V_{out}$) of the integrator 118 is supplied to a comparator 128 whose output ($V_c$) is applied to an inverter 130. The output of the inverter 130 is supplied to an AND gate 132. A switch 134, when closed for a time period $T_2$, provides for the supply of a high level signal to an input 135 to the AND gate 132 which produced a high level signal for the time period $T_x$ on output 116 when both of the inputs to the AND gate 132 are high. The development of the high level output for the time period $T_x$ is illustrated in the timing diagram in FIG. 3. The value of $T_x$ varies between analog signals according to the value of the signal being inputted through switch 124 for the time period $T_1$.

The output of the AND gate 114 is connected to dividing means in the form of a conventional divide by N circuit 136 which comprises pulse control means for the circuit 110, and the output of which is connected to a binary coded decimal counter (BCD) 138 and through a switch 140 having a contact **140*a* to a binary counter 142 which forms the storage means for the circuit 110. A multiplexer 144 is connected to the dividing means 136 and provides for the alternative application of the two numbers. A predetermined number N, 100 in the illustrated embodiment, is hardwired to the multiplexer to be applied to the divide by N circuit 136 when the reference analog signal $V_1$ is applied to the input 120 through the switch 124. When successive test analog signals $V_2$ are applied to the input 120, the number $N_1$ which had been retained in the binary counter 142 is applied to the divide by N circuit 136**.

Control logic circuitry 148 is provided having switches 150 and 152 and controls the operation of the switches 122, 124, 134 and 140. The control circuitry 48 also functions to control the counters 138 and 142 and the multiplexer 136. The switch 150 has contacts **150*a* and 150*b* and when contact 150*a* is closed, the contact 140*a* is closed to enable the output of the divide by N circuit 136 to be supplied to the binary counter 142. When the contact 150*b* is closed, the switch 140 is opened and the multiplexer 144 is controlled so that the number $N_1$ representing the reference analog signal $V_1$ and stored in the counter 142 is applied to the divide by N circuit 136**.

The display counter 138 is connected to digit drivers 154 which are in turn connected to the displays 156 for the purposes of generating a decimal readout of the ratio between the reference analog signal $V_1$ stored in the counter 142 and the test analog signal $V_2$ being supplied to the control means 113.

In operation of the computing circuit 110, a reference analog signal is initially applied to the integrator 118 through the switch 124 which remains closed for a fixed time period $T_1$. The integrator 118 integrates this signal above the crossing level, indicated at 160 in FIG. 3. At the end of the time period $T_1$, the switch 124 is opened and the switch 122 is closed for the time period $T_2$ to apply a predetermined reference voltage level $V_{ref}$ of opposite polarity to the integrator 118. The comparator 18 thus generates an output until the voltage crosses the level 160. The AND gate 132 therefore produces an output for a time period $T_x$ dependent upon the level of the analog signal being applied through the switch 124.

When the reference analog signal $V_1$ is to be applied to the computing circuit 110, the switch 150 is moved to close the contact **150*a* which notifies the control logic 148 to provide for the closing of the contact 140*a*. The control circuitry 148 also provides for the control of the multiplexer 144 so that the number N, 100 in this case, will be inputted to the divide by N circuit 136. The output of the AND gate 132 is applied to the AND gate 114 for the time period $T_x$ to permit the passage of the clock pulses to the divide by N circuit 136. The divided output is transmitted to the display counter 138 and represents the absolute conversion of the reference analog signal $V_1$ to a digital signal that is displayed. The output of the divide by N circuit 136 is also inputted into the counter 142** which stores the digital representation of the reference analog signal $V_1$ as a number $N_1$.

The generation of a ratio between the stored reference signal $N_1$ and a successive analog signal $V_2$ proceeds as follows. The switch 152 is momentarily closed providing for the resetting of the display counter 138 to zero and for resetting the divide by N circuit 136. The switch 150 is actuated to close the contact **150*b* which notifies the control logic circuitry 148 to open the switch 140 and to control the multiplexer 144 to apply the stored number $N_1$ in the counter 142 to the divide by N circuit 136**.

The successive analog signal $V_2$ is supplied to the dual slope integration analog to digital converter 113 in the manner described above to enable the passage of pulse signals from the oscillator 112 through the AND gate 114 for a time period $T_x$. These pulse signals are then divided by the number $N_1$, which is stored in the counter 142. The divided output is supplied to the display counter 138 for displaying the ratio between the reference and analog signals in a decimal form on the displays 156.

To obtain another ratio, the operator closes the switch 152 for a moment to clear the display counter 138 and the divide by N circuit 136 but leaves the contact 150b closed to retain the digital representation $N_1$ of the reference analog signal $V_1$ in the counter 142.

The number N, which is hardwired to the multiplexer 144, is any predetermined value and in the illustrated embodiment is a value which provides for the ratio of the reference and analog signals to deviate about the number 100. As can be seen, the output of the divide by N circuit 136 is dependent on the time period $T_x$ which is dependent on the level of the particular analog signal and the value of the number being inputted into the divide by N circuit 136.

With reference to FIG. 1, the computing circuit 10 first performs an absolute conversion of the reference analog signal $V_1$. With the switches 34, 40 and 44 in the position shown, the switch 30 is moved to close the contact 30a causing pulse signals to be synchronously supplied to the counters 36, 42 and 46 to clock the counters according to the equation, $$N_1 = R_c \cdot T_1 \quad (1)$$

$R_c$ represents the pulse rate of the oscillator 12, $T_1$ is the time period during which the counters 36, 42 and 46 are clocked and $N_1$ is a digital representation of the reference analog signal $V_1$. The binary counter 42 increments the 8-bit DAC 54 increasing its output $V_{out}$ on line 58 according to the relationship:

$$V_{out} = N/256 \cdot V_{ref} \quad (2)$$

where N equals the binary number present on the input of the DAC 54 and $V_{ref}$ is the reference voltage applied to the DAC 54 and is assumed to be larger than the value of the analog signal being supplied to input 18. At time $T_1$, $V_{out}$ becomes greater than the reference analog signal ($V_1$) which causes the comparator 24 to shift to a low state to turn off the AND gate 14 to stop transmission of the pulses from the oscillator 12. At this point, the counters 36 and 42 have the number $N_1$ on their outputs and the display counter 46 has the binary coded decimal equivalent to the number $N_1$ on its output. Therefore at time $T_1$, the output $V_{out}$ of the DAC 54 is equivalent to $V_1$, the reference analog signal. Thus, the number displayed represents $N_1$, the digital representation of the reference analog signal.

The normalized conversion proceeds as follows. The switch 50 is set to close contact 50b and the switch 30 is opened to close the contact 30b. This opens the switch 34 and sets the switches 40 and 44 to connect the multipliers 32 and 38 to the counters 42 and 46, respectively. The counters 42 and 46 are set to zero. A successive test analog signal ($V_2$) is now supplied to the input 18. The switch 30 is then set to close contact 30a to allow the pulses $R_c$ to be passed by the AND gate 14. These pulses are now fed to the counters 42 and 46 by way of the multipliers 32 and 38, respectively. The multiplier 32 functions to produce a pulse output according to the relationship $$R_{c(out)} = N_1/256 \cdot (R_{c\ in}) \quad (3)$$

wherein $N_1$ is the number retained in the counter 36 derived from the reference analog signal $V_1$ and is equal to $V_1/V_{ref}$ (256). Therefore, $$R_{c(out)} = V_1/V_{ref} \cdot (R_{c\ in}) \quad (4)$$

The conversion proceeds with the DAC 54 being incremented at a rate defined by equation 4. At some time $T_2$, the output $V_{out}$ of the DAC 54 is incremented and becomes greater than $V_2$ causing the comparator 28 to develop a low logic level state turning off the AND gate 14. At this point, the number $N_2$ has been clocked into the counter 42 according to the relationship:

$$N_2 = V_1/V_{ref} \cdot R_c \cdot T_2 \quad (5)$$

Since $N_2 = V_2/V_{ref}$ (256), $T_2$ can be derived.

$$T_2 = V_2/V_1 \cdot (256/R_c) \quad (6)$$

The output of the display counter (BCD) 46 is clocked through the multiplier 38 according to the relationship:

$$N_{BCD} = 100/256 \cdot R_{c\ in}\, T_2 \quad (7)$$

Substituting for $T_2$, $$N_{BCD} = V_2/V_1 \cdot 100,$$

the digital representation of the ratio between the reference analog signal, $V_1$, and the test analog signal $V_2$ with a scaling factor of 100 being provided by the BRM 38.

Assume the use of an eight bit conversion system in the computing circuit 110 which is illustrated in FIG. 2, Again, the first conversion of the reference analog signal $V_1$ is an absolute conversion. The multiplexer 144 places the number 100 on the divide by N circuit 136. The display counter 138 and the binary counter 142 are clocked according to the relationship:

$$N_1 = R_c T_1/100 \cdot (V_1)/V_{ref} \quad (8)$$

where $V_1$ is the reference analog signal supplied through the switch 124 for the time period $T_1$, and $V_{ref}$ is the voltage level supplied through the switch 122 for the time period $T_2$.

The second reading and all subsequent readings to be normalized is done by switching the number $N_1$, which represents the reference analog signal $V_1$ on the binary counter 142 by way of the multiplexer 144 to the divide by N circuit 136. The number of pulses $N_2$ transmitted to the display counter 138 are determined by the relationship assuming $R_c$ equals the pulse rate output of the oscillator 12

$$N_2 = R_c T_1/N_1 \cdot V_2/V_{ref} \quad (9)$$

Substituting for $N_1$ from equation 8, $$N_2 = V_2/V_1 \cdot 100 \quad (10)$$

The number $N_2$ is the digital representation of the ratio between the reference and test analog signals and is fed to the display counter 138 for readout in decimal form on the displays 156.

From the above description it can be seen that an improved computing circuit has been disclosed wherein a reference analog signal is stored enabling the use of one test input. It is to be understood that the invention is not to be limited by the specific structure shown, but rather is to be limited only by the following claims.

What is claimed:

1. A computing circuit for producing a digital output representing the ratio between a selected pair of a plurality of analog signals, said computing circuit comprising means for producing pulse signals at a constant rate, first counter means, output counter means connected to said pulse signal producing means, control means having an input to which said analog signals are successively supplied, said control means being operable to provide for the transmission of pulse signals representative of a predetermined one of said analog signals to said first counter means, said first counter means connected to said pulse producing means for retaining a digital representation of said predetermined analog signal where said digital representation is proportional to said predetermined analog signal, and pulse signal control means connected to said first counter means where for each successive analog signal supplied to said control means input, said control means and said pulse signal control means cooperate to control the pulse signals produced by said pulse signal producing means to accumulate a count in said output counter means representing said ratio.

2. The computing circuit according to claim 1, further including second counter means and digital to analog converter means operatively associated with said second counter means for producing an analog signal representing the digital value retained in said second counter means.

3. The computing circuit according to claim 2, wherein said control means includes gate means having a plurality of inputs and an output, one of said gate means inputs being connected to said means for producing pulse signals.

4. The computing circuit according to claim 3, wherein said control means further includes gate control means having one input forming said input to said control means and having a second input connected to said digital to analog converter means from which said analog signal representing the digital value retained in said second counter means is supplied.

5. The computing circuit according to claim 4, wherein said pulse control means comprises digital rate multiplier means operatively associated with said first counter means and having an output connected to said first and second counter means when said predetermined analog signal is supplied to said one gate control input, said output of said gate means being connected to said digital rate multiplier means and said output of said digital rate multiplier being connected to said second counter means when said successive analog signal is supplied to said control means input so that the number of pulses supplied to said second counter means are commensurate with the value of said successive analog signal and the value of said digital representation of said predetermined analog signal in said first counter means.

6. The computing circuit according to claim 1, wherein said control means includes gate means having a plurality of inputs and an output, and gate control means having a plurality of inputs and an output connected to one of said gate means inputs, another of said gate means inputs being connected to said means for producing pulse signals, said input to said control means forming one of said gate control means inputs to which said analog signals are successively supplied, one of said other gate control means inputs being adapted to receive a reference analog signal, said gate control means being operable to provide for the transmission of pulse signals through said gate means commensurate with the value of said analog signal being supplied to said one gate control means input.

7. The computing circuit according to claim 6, wherein said pulse control means comprises dividing means having an input connected to said output of said gate means and having an output connected to said first counter means, said first counter means being operatively associated with said dividing means whereby said dividing means is operable to produce a digital representation of said predetermined analog signal that is retained in said first counter means, and for each successive analog signal being supplied to said one of said gate control means inputs said dividing means being operable to produce a digital output commensurate with said digital representation of said predetermined analog signal in said first counter means and with the value of said successive analog signal supplied to said input, said digital output being the ratio between said predetermined analog signal and said successive analog signal.

* * * * *